US006895697B2

(12) United States Patent
Yang

(10) Patent No.: US 6,895,697 B2
(45) Date of Patent: May 24, 2005

(54) SHOE STRUCTURE PROVIDED WITH INTERCHANGEABLE VAMPS

(76) Inventor: Chen Yi Yang, No. 117, Tian-Chyr Street, Sha-Luh, Taichung Hsien (TW)

( * ) Notice: Subject to any disclaimer, the term of this patent is extended or adjusted under 35 U.S.C. 154(b) by 0 days.

(21) Appl. No.: 10/350,123

(22) Filed: Jan. 24, 2003

(65) Prior Publication Data

US 2004/0143998 A1 Jul. 29, 2004

(51) Int. Cl.[7] ..... A43B 3/24
(52) U.S. Cl. ..... 36/101
(58) Field of Search ..... 36/101, 15, 100

(56) References Cited

U.S. PATENT DOCUMENTS 3,016,630 A * 1/1962 Twiggs, Jr. ..... 36/101
3,902,259 A * 9/1975 Cracco ..... 36/11.5
5,317,822 A * 6/1994 Johnson ..... 36/101
6,418,643 B1 * 7/2002 Yang ..... 36/101
6,442,870 B1 * 9/2002 Tsai ..... 36/11.5

* cited by examiner

*Primary Examiner*—Ted Kavanaugh
(74) *Attorney, Agent, or Firm*—Bacon & Thomas PLLC

(57) ABSTRACT

A strap shoe. The shoe includes an outsole, a retaining piece, a strap, and a pad. The outsole is provided in the upper side with a receiving slot for receiving the retaining piece which is provided in the upper side with strap slots. The strap is provided with engagement pieces and is detachably fastened to the retaining piece such that the engagement pieces of the strap are removably retained in the strap slots of the retaining piece.

6 Claims, 16 Drawing Sheets

Fig・1
PRIOR ART

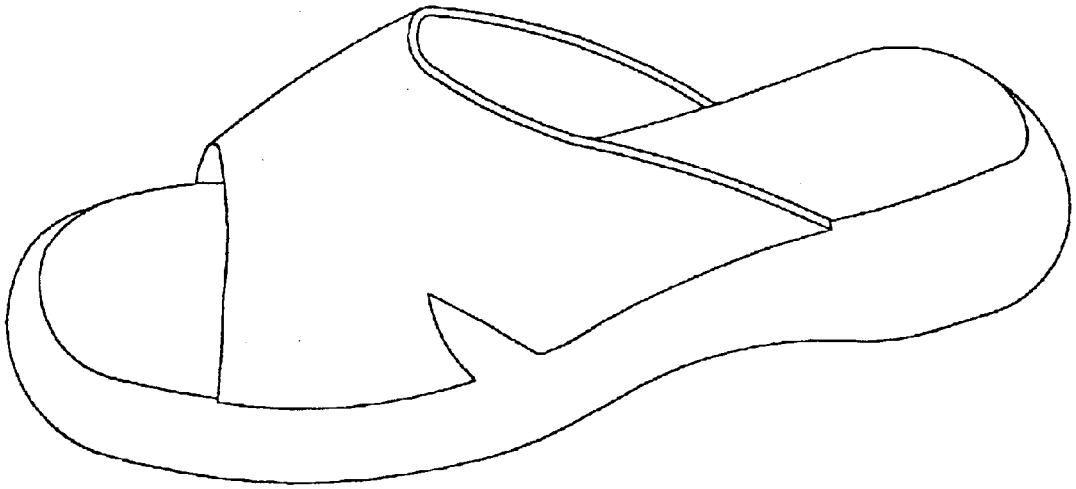
Fig・16

SHOE STRUCTURE PROVIDED WITH INTERCHANGEABLE VAMPS

FIELD OF THE INVENTION

The present invention relates to an improved shoe with interchangeable vamps, especially for a shoe structure provided with interchangeable combinations and styles of vamps.

BACKGROUND OF THE INVENTION

In the related prior art, the connected portion between a shoe board and a vamp, including sandals, sports shoes or shoes made of cotton, etc., is permanently sealed so that one cannot change the styles and patterns of the shoe. U.S. Pat. No. 6,418,643 discloses a shoe structure provided with interchangeable accessories. FIG. 1 of the application illustrates the features of U.S. Pat. No. 6,418,643, wherein the shoe board 1 includes a plurality of receiving spaces 1*a* which receive a plurality of separation pieces 2, therein. On the edges of the vamps 3 there are retaining pieces 4, which can be buckled and fixed into the separation pieces 2 in order to connect the shoe board 1 and the vamps 3. The separation pieces 2 are connected to bases 2*a* respectively.

A shoe pad 5 is positioned above the shoe board 1. Another shoe pad 6 is positioned over the shoe pad 5 and fixed to the shoe pad 5. Although different styles or types of vamps 3 can be individually connected with the shoe board 1, there are deficiencies, detailed as follows.

In the prior art device, such device is suitable for sandal structures, but not for various shoes such as sports shoes, leather shoes, and informal footwear in which the feet are totally wrapped. Therefore, the vamps of shoes that require the total covering of feet that are currently on sale, such as informal footwear and shoes made of cotton, etc. are not interchangeable. Further, prior art shoes having interchangeable vamps position the vamps at the front of the shoe, resulting in easily broken pieces between the shoe board and the vamp. There is a need for minimizing the deficiencies of the prior art.

SUMMARY OF THE INVENTION

The inventive shoe structure includes a fixing and buckling device, supplemental fixing and buckling devices positioned between the shoe board and the vamp. The fixing and buckling device includes a push piece, covering board and a buckling board. The push piece and covering board are set up in the inner side of the shoe board, especially at the edges of the push piece. There are fixing board pillars and long holes on the surface of the covering board.

The buckling board is fixed at the bottom of the vamp. At a back rib, there is a plurality of square-shaped buckling devices. By installing the buckling devices in the long holes, one can push the fixing board pillar of the push piece and fix with the buckling device. The supplemental fixing device includes a buckling base and a square-shaped buckling board, positioned at the side between the shoe board and the vamp. Thereby, different styles of vamps can be detachably connected with the shoe board, having a strong attachment.

A primary objective of the present invention is to provide a shoe structure with interchangeable vamps. The inventive device includes a push piece, covering board and a buckling board positioned between the shoe board and the front of the vamp. The push piece and the covering board are set up on the inner side of the shoe board and primarily set up with a plurality of fixing board pillars at each side rib, with a plurality of long holes on the board surface of the cover board. The buckling board is positioned at the bottom portion of the vamp. The back rib of the buckling board is configured with a plurality of square-shaped buckling bases. By fixing the buckling bases into the long holes, the fixing board pillar on the push piece can be pushed and fixed with the buckling base so as to combine the fully foot wrapped-type vamp with the shoe board.

Another object of the invention is to provide a plurality of buckling bases at both edges positioned behind the board, and the backside behind the vamp is provided with square-shaped pieces that are to be buckled with the buckling base, on which there are ribs and the square-shaped piece includes a rib piece. With the combination of the square-shaped piece and the buckling base, the combination between the vamp and the shoe board will become strengthened and fixed.

The features and the advantages of the present invention will be more readily understood from the reading of the following detailed description of the preferred embodiments of the present invention, with reference to the accompanying drawings.

BRIEF DESCRIPTION OF THE DRAWINGS

FIG. 16 is a perspective view of the second example of the present invention.

DESCRIPTION OF THE PREFERRED EMBODIMENTS

Figure 1:
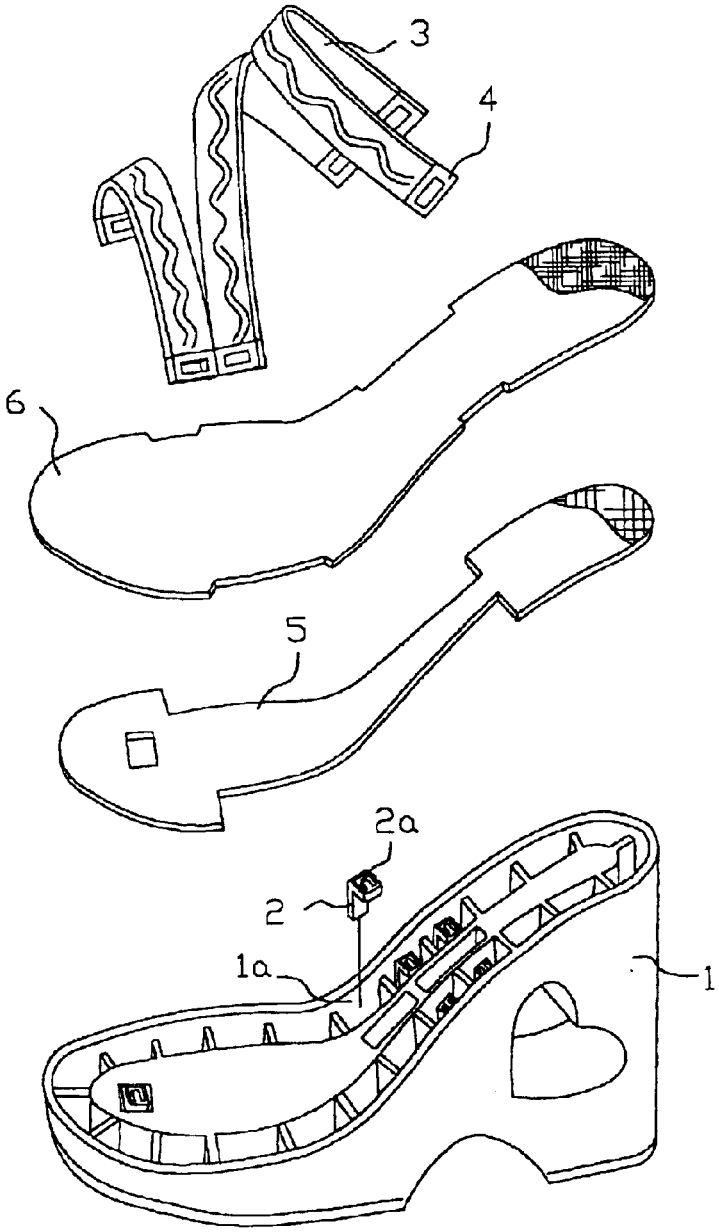
FIG. 1 shows an exploded view of the prior art.
Figure 2:
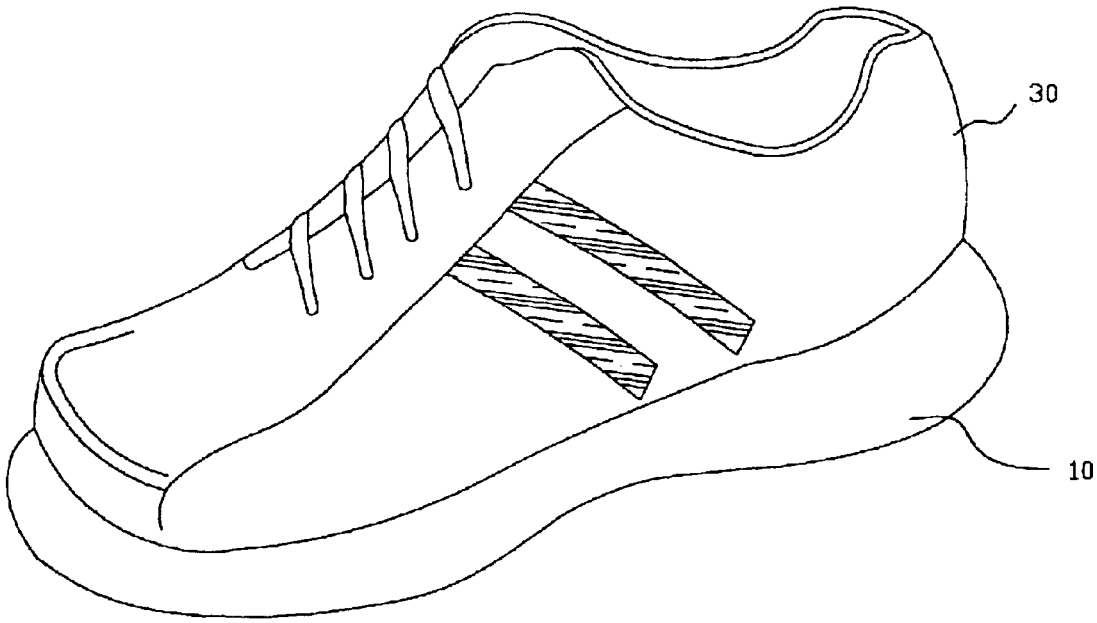
FIG. 2 illustrates a combined, perspective view of the present invention.

With reference to FIGS. 2–6, the present invention includes a shoe board 10, a shoe pad 20 and a vamp 30, a fixing buckling device 40 positioned between the shoe board 10 and the vamp 30 and supplemental fixing buckling bases 50, which enable the shoe board 10 and the vamps 30 to be disassembled and recombined to enable different combinations. The shoe board 10 is a shoe-shaped base, on which there are fixing holes 11, and its inner side is provided with components to combine with the fixing buckling devices 40 and the supplemental fixing buckling devices 40 and the supplemental fixing buckling bases 50.

The shoe pad 20 is of a smaller relative shoe shape in comparison to the shoe board 10. The shoe pad 20 is provided on its back edge with fixing pillars 21, which can be fixed into the fixing hole 11 on the shoe board 10 in order to fix the shoe pad 20 on the upper of the shoe board 10, and in order to replace the shoe pad 20. The shoe pad 20 is provided with a strap 22 at a back side thereof.

The vamp 30 has a shoe shape with coverings at side edges thereof. The bottom portion of the vamp 30 includes a fixing function between the fixing buckling device 40 and the supplemental fixing buckling base 50.

The fixing buckling device 40 includes a put-in base 41, a push piece 42, a covering board 43 and a buckling board 44.

The put-in base 41 has a tub piece shape that is provided at the front of the inner side of the shoe board 10 and is provided with a defining piece 411 that is used for the fixing of the push piece 41.

Figure 3:
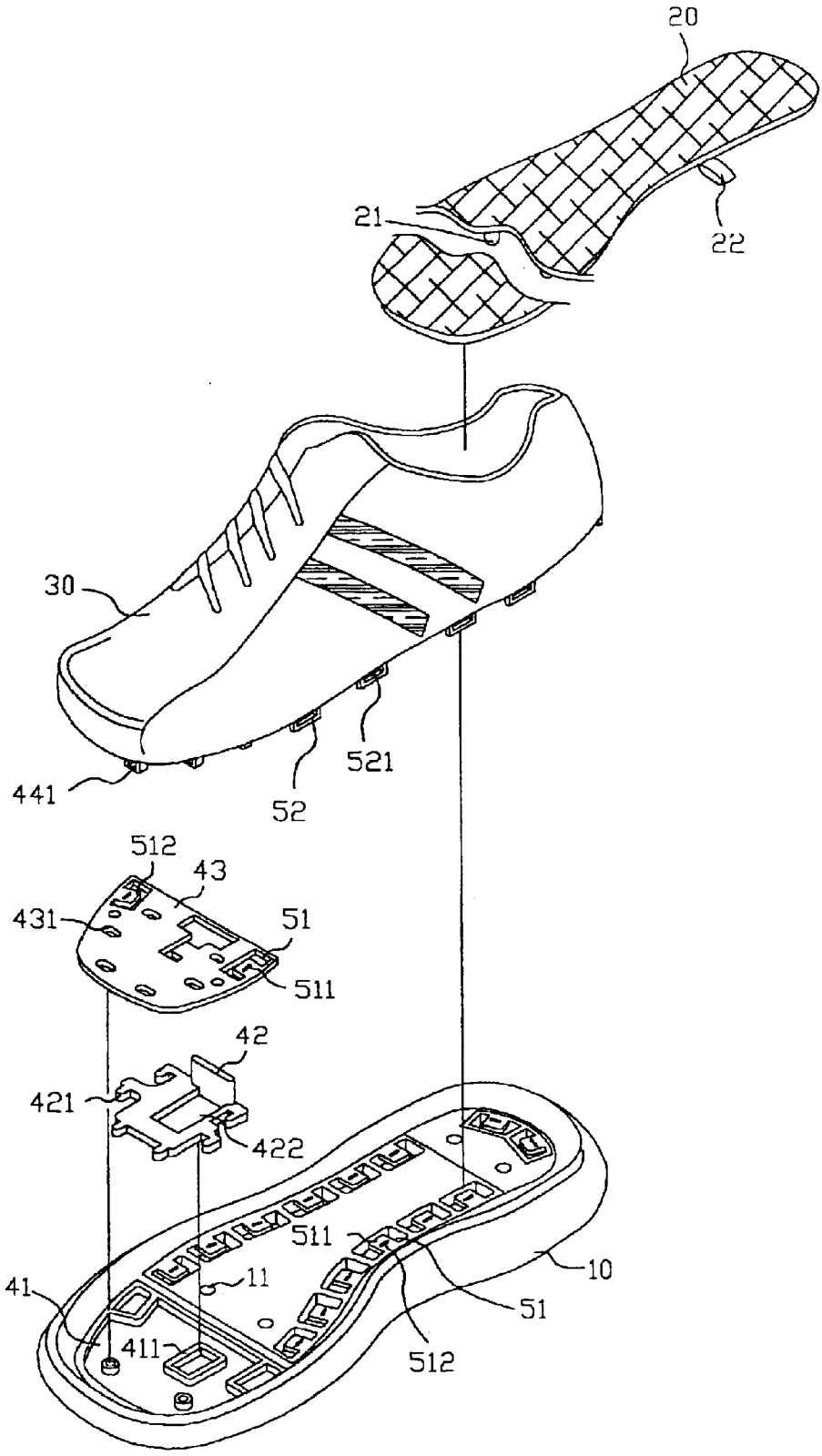
FIG. 3 is an exploded view of the present invention.

The push piece 42 is of a rectangular shape, as shown in FIG. 3. The push piece 42 is provided with a hollow part 422 that is fixed over the defining piece 411 in order to allow the push piece 42 to slip into the put-in base 41, as illustrated in FIG. 3. Side edges of the push piece 42 are provided with fixing board pillars 421.

The covering board 42 covers over the push piece 42 in relation to the put-in base 41. A portion of the covering board 43 that faces the fixing board 42 is provided with long holes 431.

Figure 4:
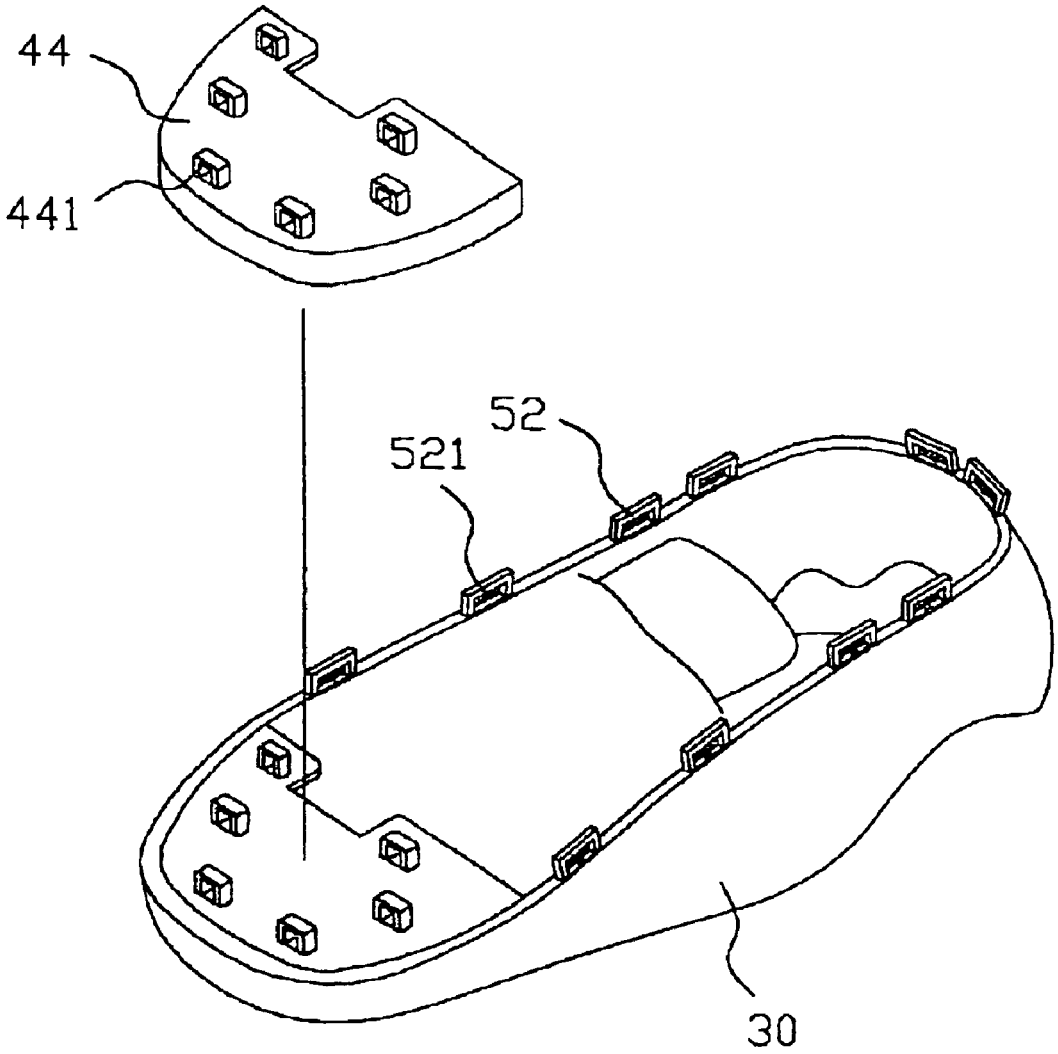
FIG. 4 is a partially exploded view of an inverted vamp and the buckling board.
Figure 5:
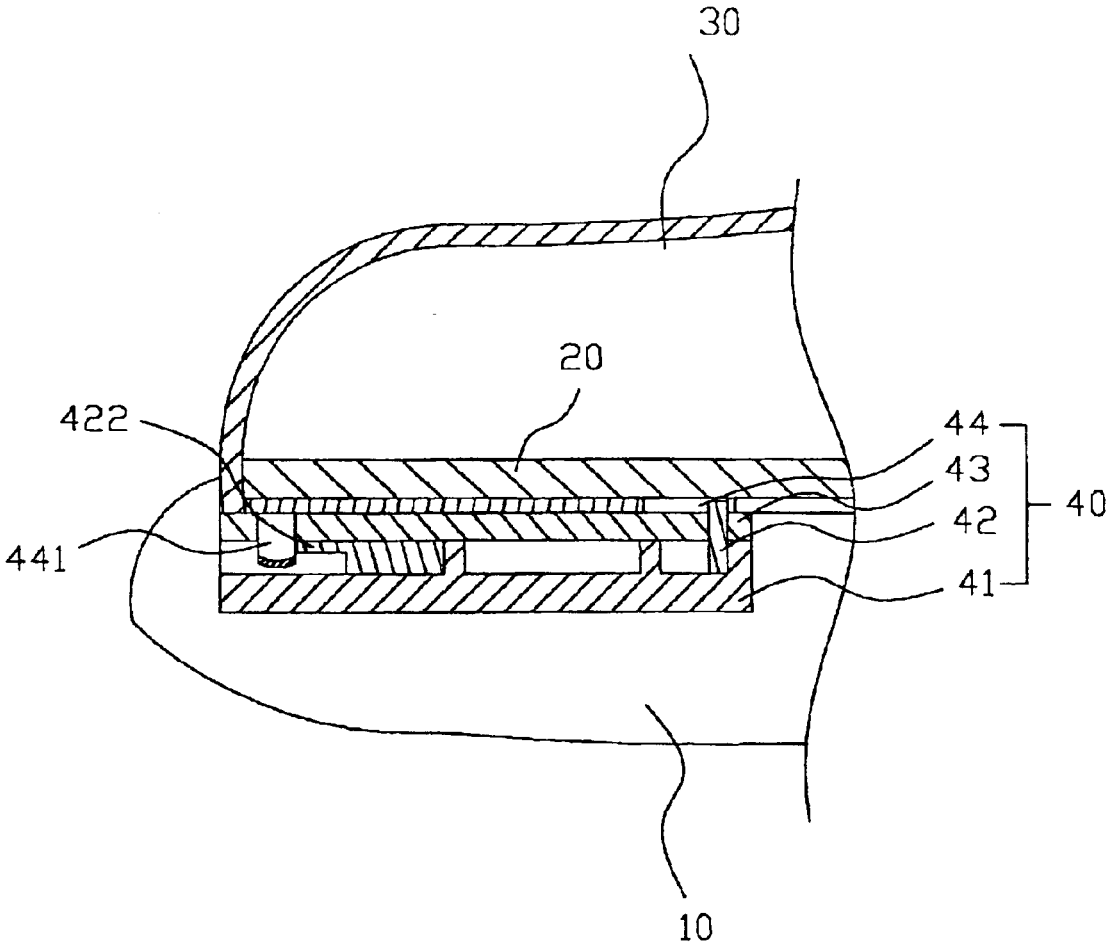
FIG. 5 is a partial cross-sectional view of a front portion of the inventive device.

The buckling board 44 is fixed to a bottom portion of the vamp 30, as illustrated in FIG. 4. The long holes 431 of the covering board 43 receive the square-shaped buckling bases 441 of the buckling board 44. The center portion of the square-shaped buckling bases 441 is hollow and the outer portion thereof is configured to be secured in the long holes 431.

The supplemental fixing buckling bases 50 each include a buckling base 51 and a square-shaped buckling board 52. At both the side and the rear of the shoe board 10 are provided with a buckling base 51 in a shoe shape, with the inner side thereof provided with a buckling piece 511 and formed with a rib 512 on the buckling piece 511. The square-shaped buckling board 52 is fixed in the central and back portions of the vamp 30, on which inner sides thereof are provided with a rib piece 521, which can be buckled and fixed with the rib 512 when the square-shaped buckling board 52 is buckled in the buckling base 51.

Thus, one can easily combine and disassemble the vamp 30, in order to interchange the informal footwear, cotton shoes, etc., in a foot wrapped configuration with the shoe board 10, to enhance the strength of the combination of the vamp 30 to the shoe board 10, and facilitating the convenient assembly thereof.

Figure 7:
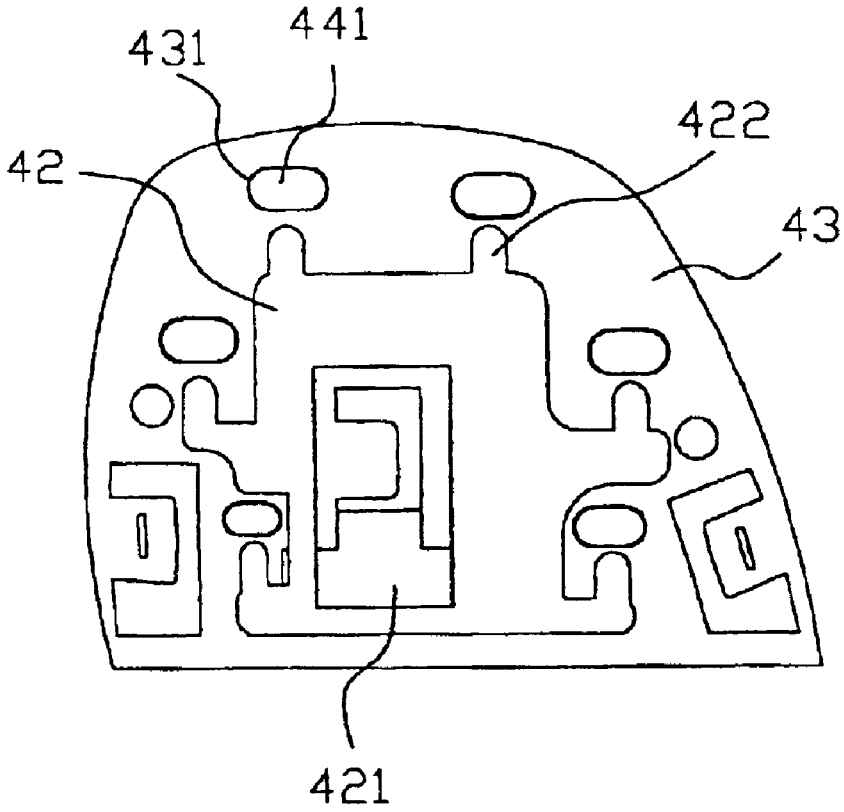
FIG. 7 illustrates a front schematic view of the fixing and buckling device of the present invention.
Figure 8:
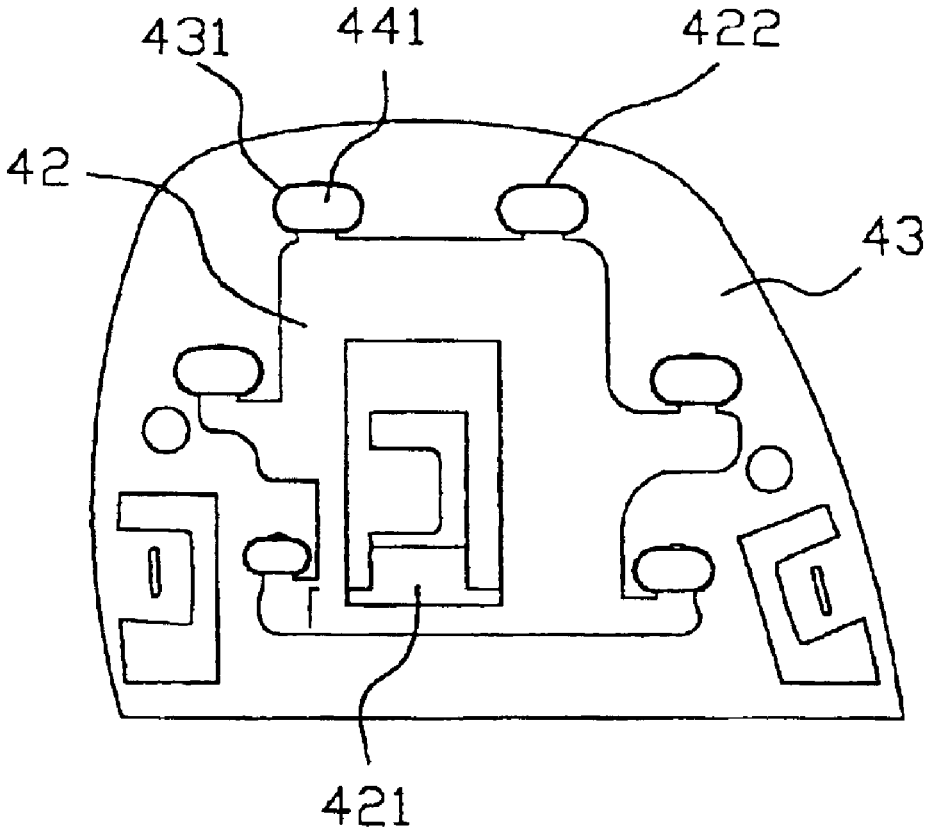
FIG. 8 illustrates a rear schematic view of the fixing and buckling device of the present invention.

With regard to FIGS. 7 and 8, each of the components of the fixing buckling device 40 and the supplemental fixing buckling bases 50 is provided at the pre-fixing position of the vamp 30 with the shoe board 10, placing the buckling set 441 on the vamp 30 into the long hole 431 of the board 43 and pushing the push piece 42 therein to let the fixing board pillar 422 of the push piece 42 to fix into the hollow part of the buckling set 441 and permit the buckling set 441 to release from the long hole 431. Thus, the shoe board 10 and the vamp 30 can be combined. The square-shaped buckling boards 52 of the vamp 30 are buckled into the buckling base 51 in order to completely combine the central and back portions between the shoe board 10 and the vamp 30. Finally, the shoe pad 20 is inserted onto the shoe board 10 of the vamp 30.

Figure 6:
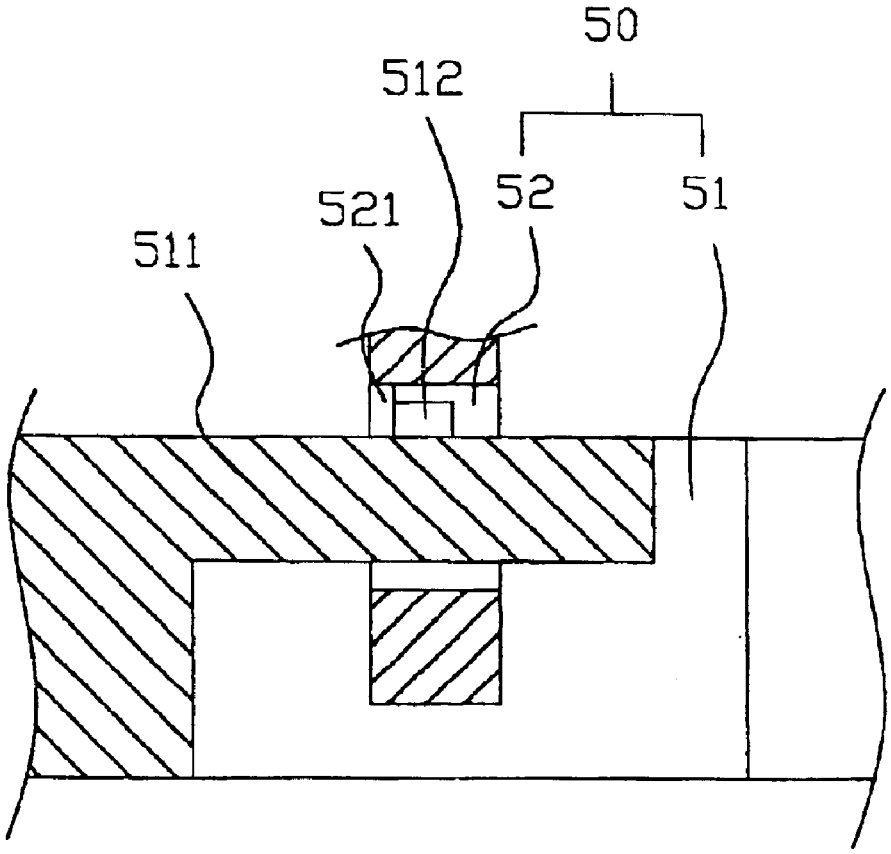
FIG. 6 is a cross-sectional view of the supplemental fixing and buckling device.

As illustrated in FIG. 6, when the square or rectangular shaped buckling board 52 is buckled into the buckling base 51, the buckling piece 511 and the rib 512 on the buckling piece 511 are combined as a combination structure that is wedged and stuck with the rib piece 521 of the buckling board 52, intensifying the combination. Further, such combination will be more convenient and quicker to assemble and disassemble the vamp 30 and the shoe board 10.

Further, when disassembling and replacing the vamp 30, one first pulls the strap 22 on the shoe pad 20 and takes out the shoe pad 20. Then, the square-shaped buckling board 52 is separated from the buckling base 51. The fixing buckling device 40 allows the push piece 42 to be pushed in an opposite direction so that the buckling set 441 will depart from the long hole 431. Thus, the vamp 30 will separate from the shoe board 10. In addition, when the square-shaped buckling board 52 is separated from the buckling base 51, one only needs to pull and twist gently in order to disassemble the vamp 30 in a fast and convenient manner.

Figure 9:
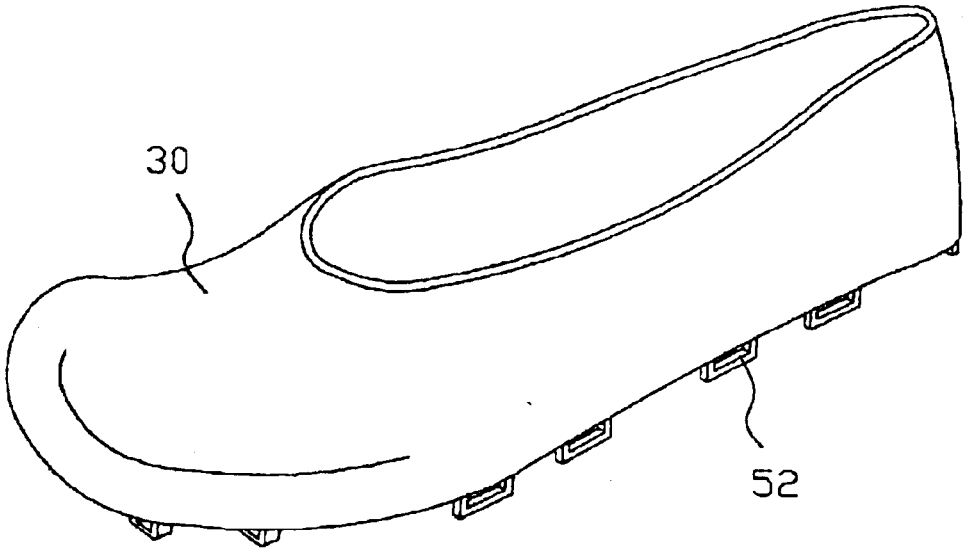
FIG. 9 is a perspective view of another type of vamp.
Figure 10:
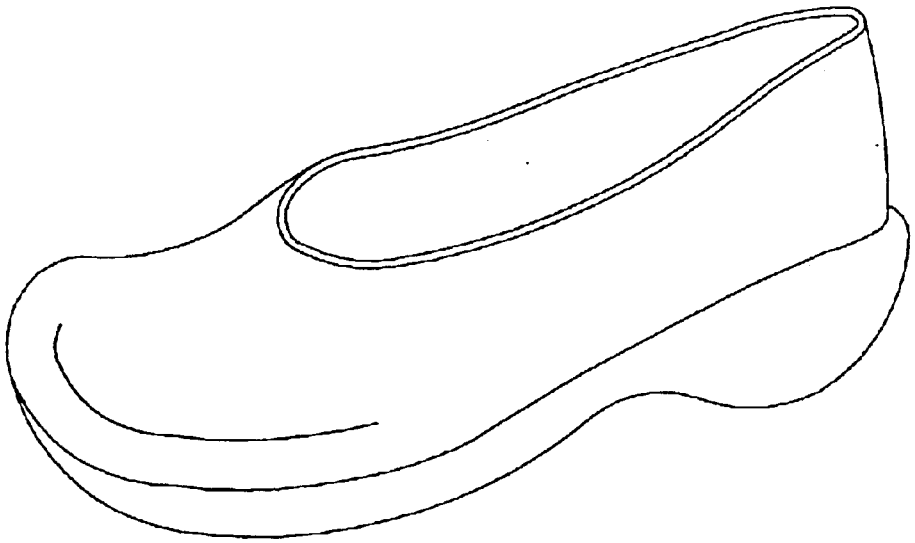
FIG. 10 is a perspective view of the second type of vamp in combination with a shoe board.
Figure 11:
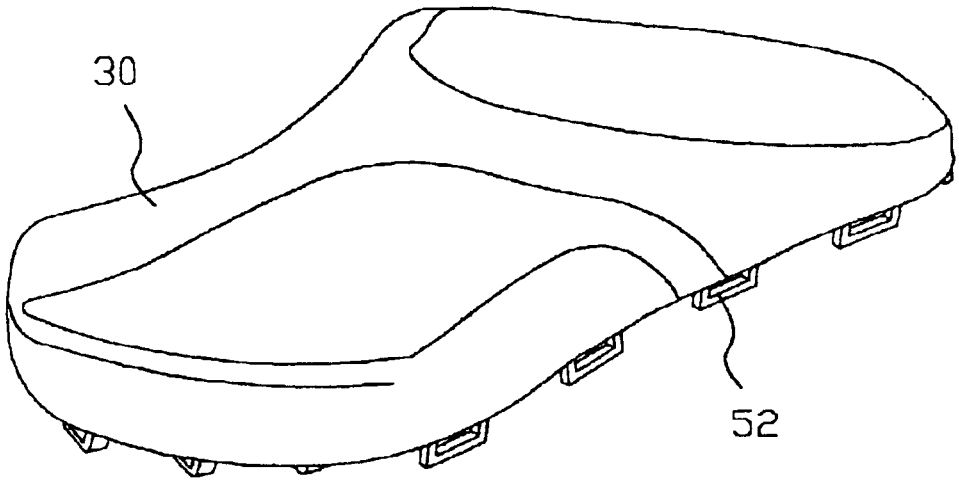
FIG. 11 is a perspective view of a third type of vamp.
Figure 12:
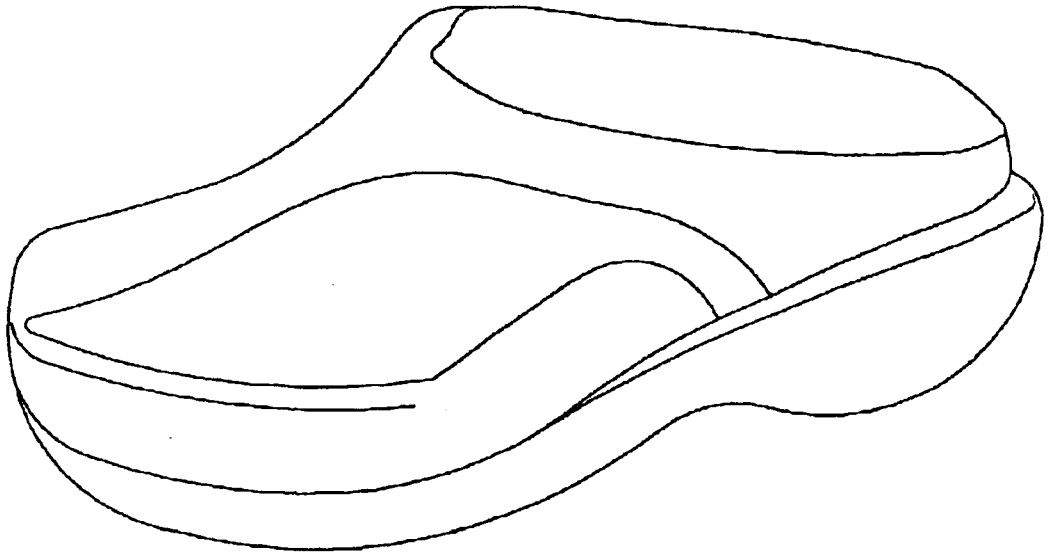
FIG. 12 is a perspective view of the third type of vamp in combination with the shoe board.
Figure 13:
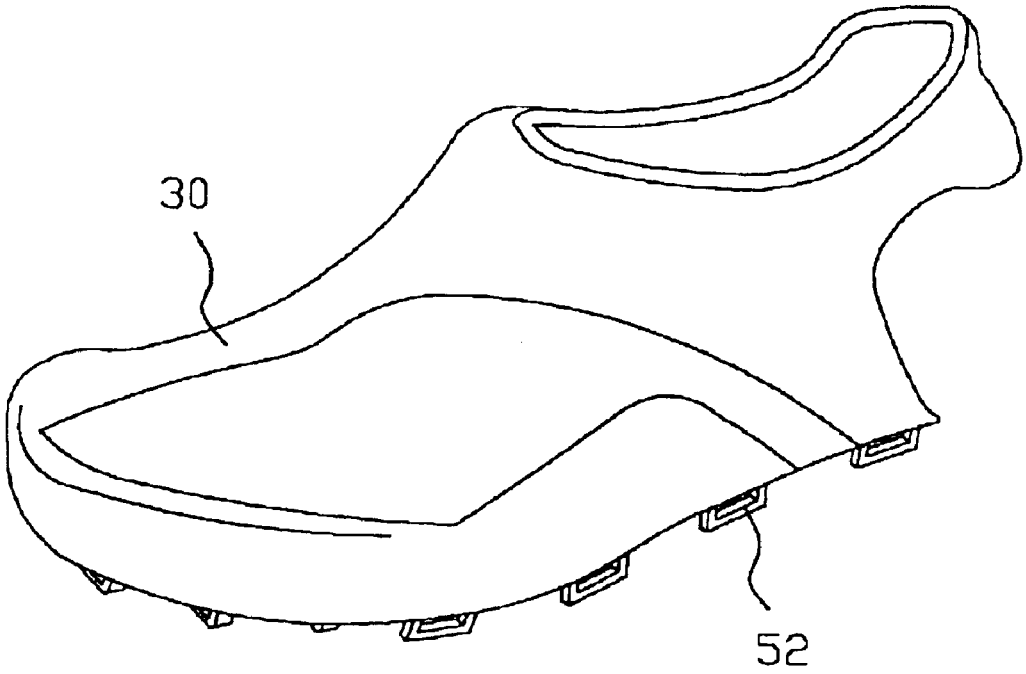
FIG. 13 is a perspective view of a fourth type of vamp.
Figure 14:
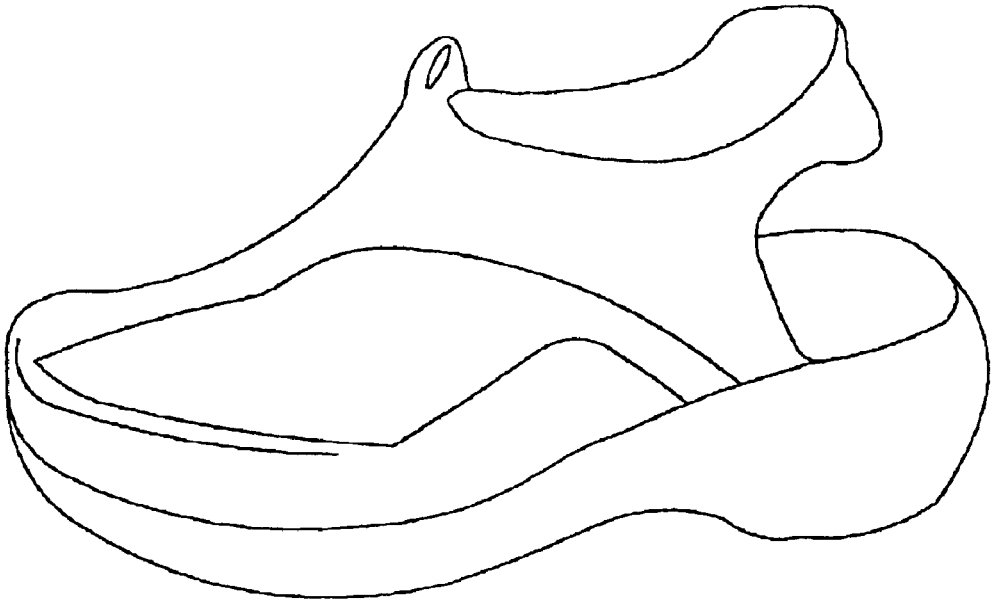
FIG. 14 is a perspective view of a fourth type of vamp in combination with the shoe board.

With regard to FIGS. 9–14, a major feature of the present invention is to permit interchanging various styles of vamps 30. The present invention can be utilized for vamps having fully foot-wrapped structures, as illustrated in FIGS. 9 and 10, or semi-wrapped wrapped structures, as illustrated in FIGS. 11–14, permitting the user to have numerous choices for wearing footwear. In addition, the shoe board 10 can be used with a variety of colors and styles for vamps 30.

Figure 15:
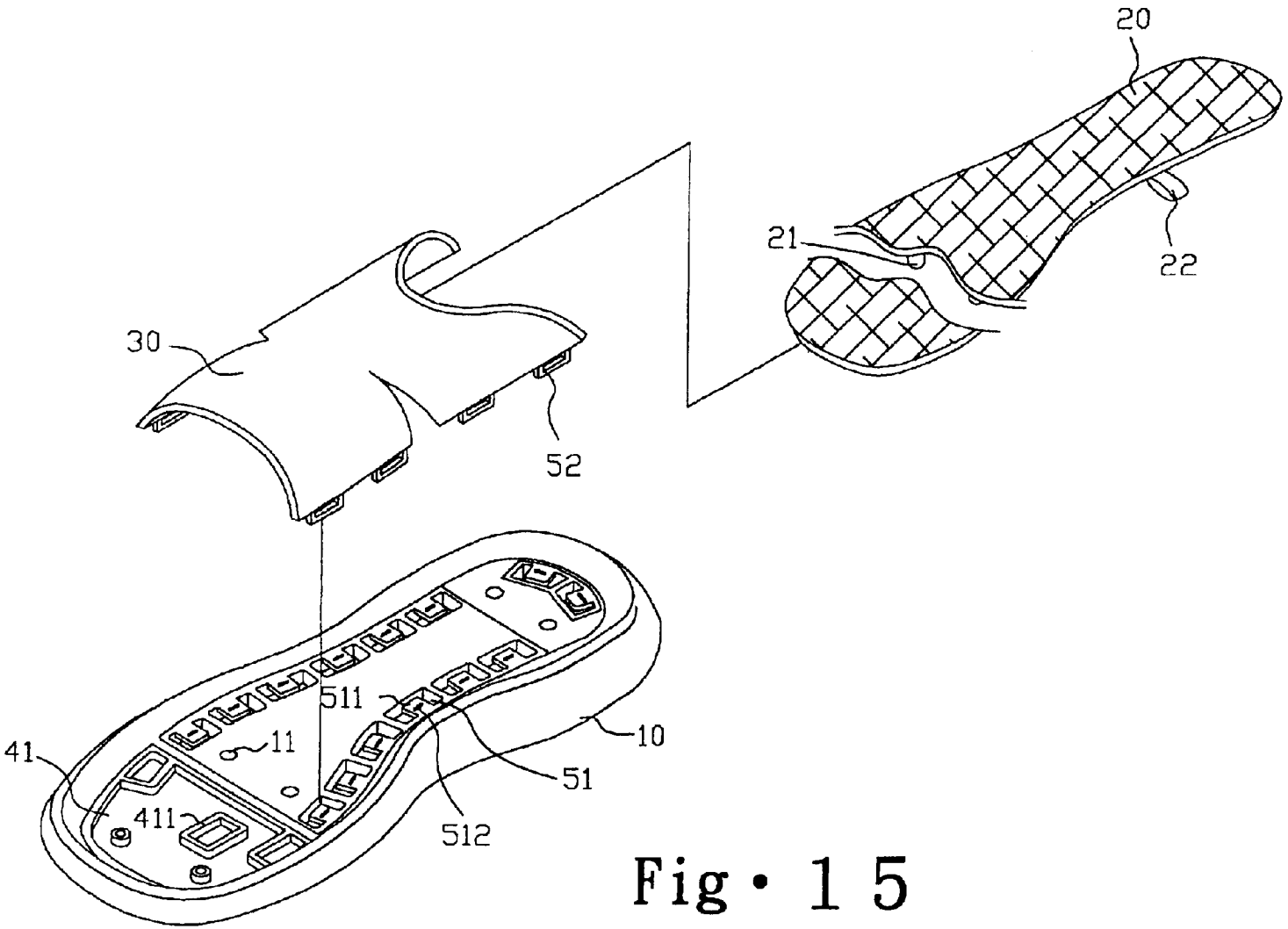
FIG. 15 is an exploded view of another example of the present invention.

In addition, the buckling base 51 of the supplemental fixing buckling base 50 can be applied on a board base having the arrangement of a shoe pattern or can be applied elsewhere on the shoe board 10 in an individual or pair type arrangement, or further applied on the covering board 43 of the fixing buckling device 40 to locate a vamp 30 of a sandal assembly. With reference to FIGS. 3, 15 and 16, sides of the covering board 43 of the fixing buckling device 40 can be provided with the buckling base 51. Thus, when a user wishes to change the vamp 30 of a sandal style shoe, one can directly buckle the square-shaped board 52 on the vamp 30 into the proper buckling bases 51 and then put the shoe pad 20 on the shoe board 10. In this manner, a user can change the foot wrapped style shoe into a sandal type shoe. FIGS. 15 and 16 illustrate a sandal styled vamp 30 buckled to a shoe board 10. The quantity and position of the square-shaped buckling board 52 can be adjusted according to the patterns and styles of the vamp 30.

What is claimed for is:

1. A shoe having an interchangeable vamp, comprising:

a shoe board, a shoe pad and a vamp;

a fixing and buckling device;

a plurality of supplemental fixing buckling bases positioned between the shoe board and the vamp in order to secure the shoe board and the vamp, wherein the shoe board can be combined with different styles of the vamp;

the fixing buckling device includes a push piece, a covering board and a buckling board, the push piece has a rectangular shape insertable onto the front of the shoe board, sides of the fixing and buckling device are provided with a plurality of irregularly arranged fixing board pillars;

the board is covered over the push piece;

a plurality of long holes are provided at the fixing board pillar facing the shoe board;

the buckling board is positioned and buckled at a bottom portion of the vamp;

a plurality of buckling sets are positioned at the long holes of the covering board at a back side thereof, the buckling sets are square in shape and are inserted into the long holes of the covering board; and when the buckling sets are positioned into the long holes, the fixing board pillars of the push piece are pushed and stuck into the inner side of the buckling sets so that the buckling board cannot be separated from the push piece.

2. The shoe as claimed in claim 1, wherein the fixing and buckling device is provided at a front of the shoe and a back portion of the shoe is provided with a plurality of supplemental fixing buckling bases positioned between the shoe board and the vamp in order to fix the shoe board to the vamp, the supplemental fixing buckling devices comprise a buckling base and a square-shaped bucking board, the buckling base is provided at both sides thereof and the back side of the shoe board, the inner side of the buckling base is provided with a buckling piece and the buckling piece forms a rib, the square-shaped buckling board is provided at the back side of the vamp, a rib piece is provided at an inner side thereof, and the rib piece can be bucked and stuck with the rib.

3. The shoe as claimed in claim 2, wherein each of the supplemental fixing buckling bases are provided on a board having a shoe-shaped arrangement or is provided at the shoe board and the fixing buckling device in individual or pairs so that a sandal style vamp can be combined with the shoe board.

4. The shoe as claimed in claim 1, further comprising a put-in base which is provided at an inner side of the shoe board, and configured to be set thereon by the push piece and a hollow part is provided on the push piece to receive the defining piece on the put-in base.

5. The shoe as claimed in claim 1, further comprising a plurality of fixing board pillars that are provided at a back side of the shoe pad in order to set the fixing hole of the shoe board, and a pull strap is provided at the back side of the shoe pad.

6. The shoe as claimed in claim 1, wherein the vamps can be interchanged with various vamp styles.

* * * * *